US006290300B1

(12) United States Patent
Sutton et al.

(10) Patent No.: US 6,290,300 B1
(45) Date of Patent: Sep. 18, 2001

(54) ADJUSTABLE ARM CHAIR BRACKET

(76) Inventors: Donald E. Sutton, 223 Zinfandel Rd., Hearldsburg, CA (US) 95448; Douglas A. Learned, 507 Redwood Ave., Sand City, CA (US) 93955

( * ) Notice: Subject to any disclaimer, the term of this patent is extended or adjusted under 35 U.S.C. 154(b) by 0 days.

(21) Appl. No.: 09/516,893

(22) Filed: Mar. 2, 2000

Related U.S. Application Data

(60) Provisional application No. 60/123,076, filed on Mar. 4, 1999.

(51) Int. Cl.[7] ..... A47C 7/54
(52) U.S. Cl. ..... 297/411.37; 297/411.35
(58) Field of Search ..... 297/411.37, 411.35, 297/411.38, 411.2, 411.31, 411.3; 248/118, 118.1

(56) References Cited

U.S. PATENT DOCUMENTS 5,380,065 1/1995 Rohrer .
5,407,249 4/1995 Bonutti .
5,484,187 1/1996 Doerner et al. .
5,641,203 6/1997 Van De Riet et al. .
5,839,786 11/1998 Cvek .
5,884,976 * 3/1999 Breen et al. .
5,975,640 * 11/1999 Chen .
6,017,091 * 1/2000 Cao .
6,045,191 * 4/2000 Piretti .
6,076,891 * 6/2000 Bernhardt .

* cited by examiner

*Primary Examiner*—Milton Nelson, Jr.
(74) *Attorney, Agent, or Firm*—Patent & Trademark Services; Joseph H. McGlynn

(57) ABSTRACT

An adjustable arm chair bracket which will attach a chair arm rest to a chair. The arm rest can then be adjusted to suit individuals of different sizes. The bracket has three arms, one of which is connected to the chair, the second has the arm rest attached thereto, and the third arm connects the first and second arm. Spring biased ball detents are used to lock the bracket in various positions to adjust the bracket to the convenience of different users.

12 Claims, 2 Drawing Sheets

ADJUSTABLE ARM CHAIR BRACKET

This is a conversion of Provisional application Ser. No. 60/123,076, filed Mar. 4,1999.

BACKGROUND OF THE INVENTION

This invention relates, in general, to arm chair brackets, and, in particular, to an adjustable arm chair bracket.

DESCRIPTION OF THE PRIOR ART

In the prior art various types of arm chair brackets have been proposed. For example, U.S. Pat. No. 5,839,786 to Cvek discloses an arm rest which is rotatably attached to an arm of a chair, and the arm rest can be pivoted to a plurality of locations.

U.S. Pat. No. 5,484,187 to Doerner et al discloses a three part bracket which allow a rotatable arm rest to be attached to a chair arm.

U.S. Pat. No. 5,641,203 to Van De Riet et al discloses an adjustable arm rest assembly pivotably attached to an arm rest of a chair and which has detents to lock the assembly in a plurality of positions.

U.S. Pat. No. 5,407,249 to Bonutti discloses a pivotably mounted arm rest which can be locked in a plurality of positions.

U.S. Pat. No. 5,380,065 to Rohrer discloses a three part bracket which allows an arm rest to be pivotably mounted on a chair arm.

SUMMARY OF THE INVENTION

The present invention is directed to an adjustable arm chair bracket which will attach a chair arm rest to a chair. The arm rest can then be adjusted to suit individuals of different sizes. The bracket has three arms, one of which is connected to the chair, the second has the arm rest attached thereto, and the third arm connects the first and second arm. Spring biased ball detents are used to lock the bracket in various positions to adjust the bracket to the convenience of different users.

It is an object of the present invention to provide a new and improved adjustable arm rest bracket for a chair.

It is an object of the present invention to provide a new and improved adjustable arm rest bracket that can be easily adjusted to the convenience of different users.

It is an object of the present invention to provide a new and improved adjustable arm rest bracket that can be attached to a variety of chairs.

These and other objects and advantages of the present invention will be fully apparent from the following description, when taken in connection with the annexed drawings.

DESCRIPTION OF THE PREFERRED EMBODIMENT

Figure 1:
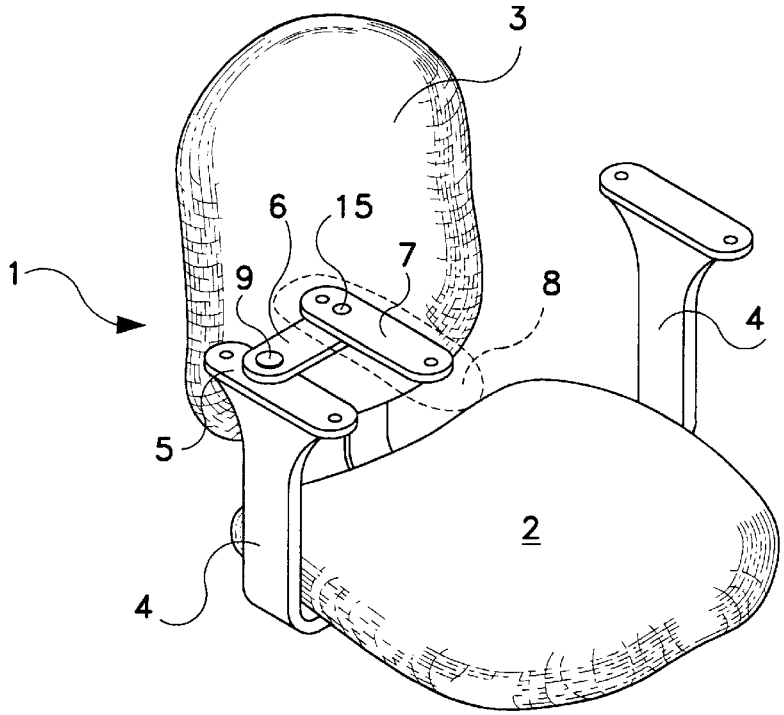
FIG. 1 is perspective view of the present invention attached to the arm rest of a chair.

Referring now to the drawings in greater detail, FIG. 1 shows the present invention 1 attached to a chair with a back rest 3 and a seat portion 2. The adjustable bracket of the present invention is attached to a vertical arm rest support 4 secured to the chair seat 2 in any conventional manner such as, but not limited to, screws or bolts.

The bracket of the present invention comprises at least two arms, although three arms 5, 6, 7 (shown in FIGS. 1 and 3) are preferred, which can be made from any suitable material with solid machined aluminum being the preferred material. The arm 5 is attached to the top of the vertical arm rest support 4 in any conventional manner such as by screws or bolts. The arm 5 is secured to the arm 6 by means of a pivot pin as shown in FIG. 2.

Figure 3:
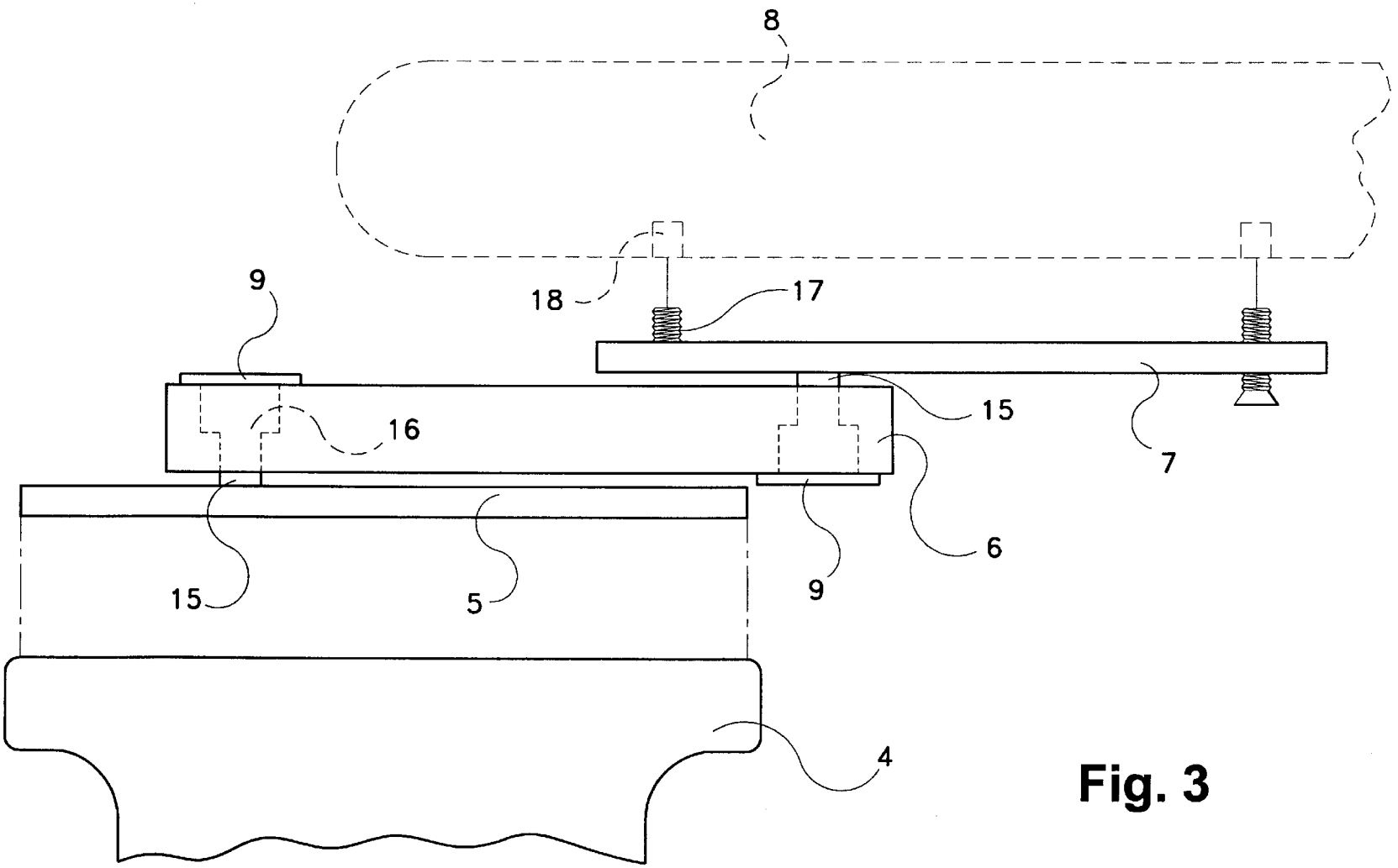
FIG. 3 is a side view of the adjustable bracket of the present invention.

The pivot pin comprises three sections 9, 10, 15. The top section 9 will overlie the top of the arm 6, as shown in FIG. 3, to prevent the arm from being detached. The middle section 10 of the pivot pin will fit within a recess or aperture 16 shown in dotted lines in FIG. 3. The bottom section 15 will be rotatably secured to the arm 5 in any conventional manner so it can rotate 360° with respect to the arm 5.

Figure 2:
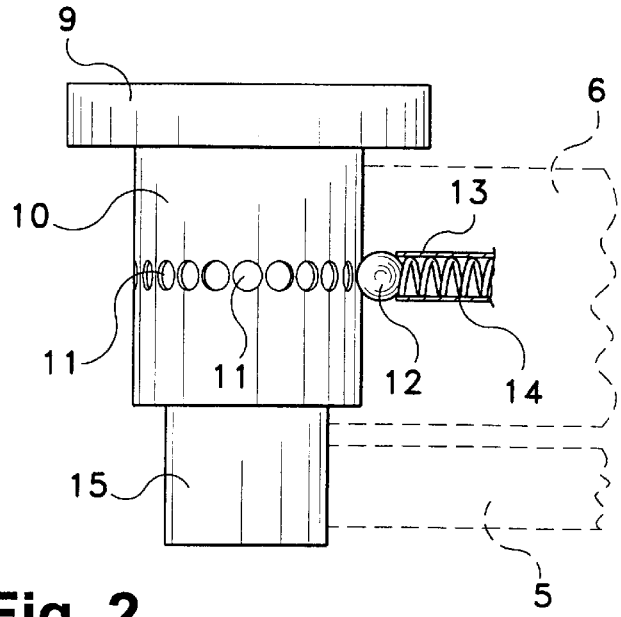
FIG. 2 is a partial side view of the adjustable locking mechanism of the present invention.

As more clearly shown in FIG. 2, the center section 10 of the pivot pin has a plurality of recesses 11 spaced around the periphery of this center section 10. There are 24 recesses 11 spaced at 15° around center section 10, although the number of recesses and the spacing of the recesses can be varied without departing from the scope of the invention. Secured within an adjacent recess in the arm 6 is a locking means which will cooperate with the spaced recesses 11 to hold the arms 5, 6 in any relative position with respect to each other.

The recess in the arm 6 contains a holder 13 which houses a spring 14. The spring 14 biases a ball 12 toward the center pivot pin section 10. When the ball 12 aligns with one of the recesses 11, the ball will be biased into the recess by the spring 14, and this will lock the relative positions of the two arms 5, 6. Therefore, the user can adjust the relative position of the bracket arms 5, 6 to a position that is most comfortable to the user, and once the user has the bracket arms 5, 6 is the preferred position, the ball detent 12 cooperating with the recesses 11 will hold the bracket arms 5, 6 in this position.

Therefore, by merely rotating arm 5 with respect to arm 6, different users can adjust the entire arm rest on the chair to a position that is comfortable to them. In addition, the same user can easily adjust the arm rest, at different times of the day as fatigue sets in. In this way a user can adjust the arm rest easily and conveniently during the day to avoid fatigue, which leads to poor work habits and errors. Because the arms are extremely easy to adjust (there are no locking pins or adjustment screws to manipulate to adjust the arm rest) a user is more likely to adjust the arm rest bracket as the need arises, and therefore, avoid a poorly adjusted arm rest.

A third arm 7 is attached to the arm 6 in the same manner as the arm 6 is attached to the arm 5 (i.e. by means of a pivot pin as shown in FIG. 2). The arm 7 can be adjusted with respect to the arm 6 in the same easy, convenient manner as described above with respect to the adjustment between the arms 5, 6. The addition of the third arm 7 offers the user greater versatility with respect to the position that the arm rest is placed into, and this translates into a chair which will be more comfortable to use, whether it is being used by a single person or more a plurality of persons. Again, this ease in adjusting the arm rest means that a person will avoid fatigue (which results in mistakes and errors) and that different people can use the same chair and easily adjust the chair to their individual requirements.

As shown in FIGS. 1 and 3, a polyurethane arm pad 8 can be attached to the arm bracket 7 in any conventional manner such as by bolts 17 which thread into recesses 18 in the underside of the pad 8. Since this is a conventional attachment means for an arm rest pad no further description is necessary. Also, the type of material that the pad 8 is made from can be varied without departing from the scope of the invention.

It should be noted that while the present invention has been described with three arm brackets 5, 6, 7, it should be noted that it could use two arm brackets or more than three, however, three arm brackets are the preferred number to offer the user the proper amount of versatility in positioning the arm rest in the comfortable fashion.

Although the Adjustoyou Arm Chair Bracket and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. An adjustable arm rest adapted to be attached to a chair arm rest, said adjustable arm rest comprising:

a first arm having means for rotatably connecting said first arm to said chair arm rest, a second arm rotatably connected to said first arm at a distance spaced from said means for rotatably connecting said first arm to said chair arm rest, said means for rotatably connecting said first arm to said chair arm rest comprising a vertical fastener extending through said first arm and having means for securing said vertical fastener to said chair arm rest, means in said first arm cooperating with means in said vertical fastener for adjustably securing said first arm with respect to said vertical fastener, and thereby adjustably securing said first arm with respect to said chair arm rest, and wherein said second arm has means for rotatably connecting said second arm to said first arm, said means for rotatably connecting said second arm to said first arm comprising a second vertical fastener extending through said second arm and having means for securing said second vertical fastener to said first arm, means in said second arm cooperating with means in said second vertical fastener for adjustably securing said second arm with respect to said second vertical fastener, and thereby adjustably securing said second arm with respect to said first arm.

2. The adjustable arm rest as claimed in claim 1, wherein said means for rotatably connecting said first arm to said chair arm rest operates independently from said means for rotatably connecting said first arm to said second arm.

3. The adjustable arm rest as claimed in claim 1, wherein said means in said second arm which cooperates with means in said second vertical fastener for adjustably securing said second arm with respect to said second vertical fastener is a plurality of apertures.

4. The adjustable arm rest as claimed in claim 3, wherein said plurality of apertures extend completely around a circumference of said second vertical fastener.

5. The adjustable arm rest as claimed in claim 1, wherein said means in said first arm which cooperates with means in said vertical fastener for adjustably securing said first arm with respect to said vertical fastener is a plurality of apertures.

6. The adjustable arm rest as claimed in claim 5, wherein said plurality of apertures extend completely around a circumference of said vertical fastener.

7. The adjustable arm rest as claimed in claim 1, wherein said means in said first arm cooperating with means in said vertical fastener for adjustably securing said first arm with respect to said vertical fastener is a movable projection.

8. The adjustable arm rest as claimed in claim 7, wherein said movable projection is spring biased.

9. The adjustable arm rest as claimed in claim 7, wherein said movable projection is a ball.

10. The adjustable arm rest as claimed in claim 1, wherein said means in said second arm cooperating with means in said second vertical fastener for adjustably securing said second arm with respect to said second vertical fastener is a second movable projection.

11. The adjustable arm rest as claimed in claim 10, wherein said second movable projection is spring biased.

12. The adjustable arm rest as claimed in claim 10, wherein said second movable projection is a ball.

* * * * *